US005242172A

United States Patent [19]

Bateman

[11] Patent Number: 5,242,172

[45] Date of Patent: Sep. 7, 1993

[54] CONVERTIBLE TRACK MOUNTED RUNNING TARGET

[76] Inventor: Kyle E. Bateman, P.O. Box 636, Provo, Utah 84603-0636

[21] Appl. No.: 842,987

[22] Filed: Feb. 28, 1992

[51] Int. Cl.[5] ..... F41J 9/02

[52] U.S. Cl. ..... 273/369

[58] Field of Search ..... 273/369, 370

[56] References Cited

U.S. PATENT DOCUMENTS

| | | | |
|---|---|---|---|
| 3,140,874 | 7/1964 | Jensen et al. | 273/369 |
| 3,324,832 | 6/1967 | McCain | 273/369 X |
| 3,865,373 | 2/1975 | Knight | 273/369 |
| 4,700,952 | 10/1987 | Patsy | 273/369 |

*Primary Examiner*—William H. Grieb

[57] ABSTRACT

A support structure and system which holds a cardboard or paper target above a small, lightweight carriage which moves back and forth under operator control. The system is highly portable (with the exception of the track) and can be set up very quickly and easily. The unique design allows use of commercially available, rolled steel beams (such as standard I-beam or flat bar steel) to implement the track structure. The universal mounting design allows the target system to attach to an I-beam track in any one of 8 different ways. Specifically, it can run "right side up" or "up side down"; it can mount on either of the two flanges of the I-beam (such that two target systems can operate simultaneously on a single track); and its motor drive unit can be positioned on either end of the track. The low-mass carriage and the increased-traction roller design allow the quick direction changes necessary in tactical target training.

4 Claims, 4 Drawing Sheets

CONVERTIBLE TRACK MOUNTED RUNNING TARGET

BACKGROUND

Other moving target systems that are commercially available suffer from one or more disadvantages which this present invention helps remedy. These disadvantages include being larger, heavier, less portable, relatively slow reacting, relatively complex, difficult to manufacture, difficult to ship, difficult to install, less versatile, and incapable of being installed without relatively large amounts of prior preparation.

SUMMARY

It is an object of the present invention to provide an improved moving target system comprising:

(a) A support structure and system which holds a cardboard or paper target above a carriage which moves back and forth under operator control;

(b) A universal mechanical interface to a track structure which can be readily acquired by the user from a standard commercial source rather than requiring a specialized track structure from the manufacturer;

(c) An extremely low mass, low friction carriage which allows quicker starts and stops;

(d) A unique roller design which increases traction on the drive cable to further aid in quick starting and stopping.

(e) A universal mounting design which allows the motor drive unit to function equally well at either end of the track structure, thereby providing easier retro-fit installation into existing environments;

(f) A universal mounting design which allows the entire assembly to be mounted to the track system either "right side up" or "up side down";

(g) A universal mounting design which allows the entire assembly to operate on either of the two standard I-beam flanges, thereby allowing operation of two independent moving target systems on the same track; and (g) A unique clamping design which allows the drive components to mount to the track at any location without requiring modification of the track such as drilling, welding, etc., thereby allowing the user to change the distance the target can run by simply sliding the drive components back and forth on the track.

DESCRIPTION OF THE PREFERRED EMBODIMENT

Referring to the accompanying drawings, there is illustrated a preferred embodiment of the Convertible Track Mounted Running Target according to the present invention. Most of the structural components are preferably fabricated from mild steel which has been plated or painted. The carriage plate (1) and cable bracket (2) are preferably fabricated from aluminum plate.

Figure 1:
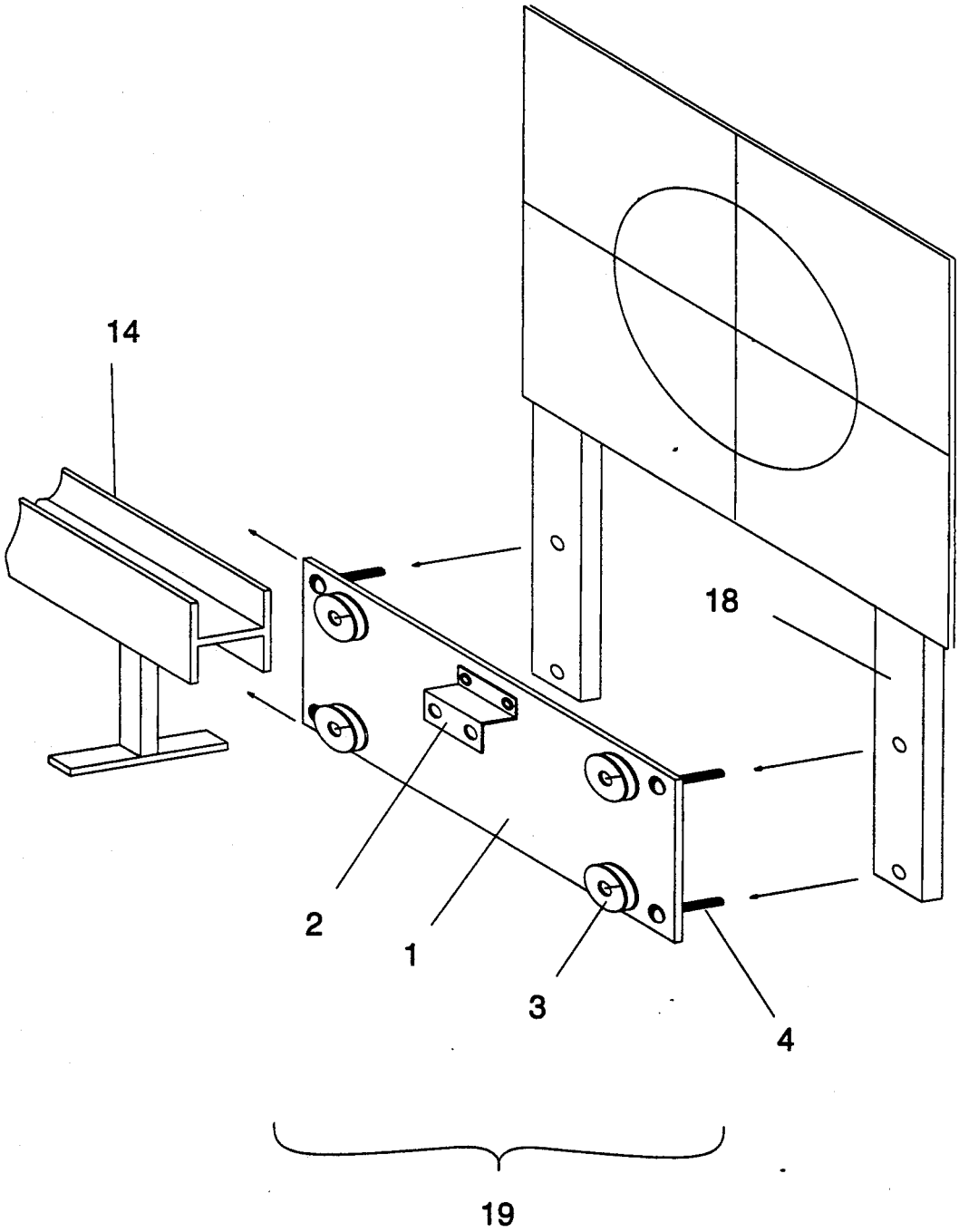
FIG. 1 shows a view of an embodiment of the carriage in accordance with the present invention along with illustrations of a sample target and I-beam track, both of which are not a part of this present invention.

The carriage (19) (see FIG. 1) is comprised of the cable bracket (2), the carriage wheels (3), and the target mounting studs (4) which are all bolted onto the carriage plate (1). Each carriage wheel (3) is preferably comprised of a standard, commercially available steel pulley with a standard, commercially available, post mounted, ball bearing at the center.

Figure 2:
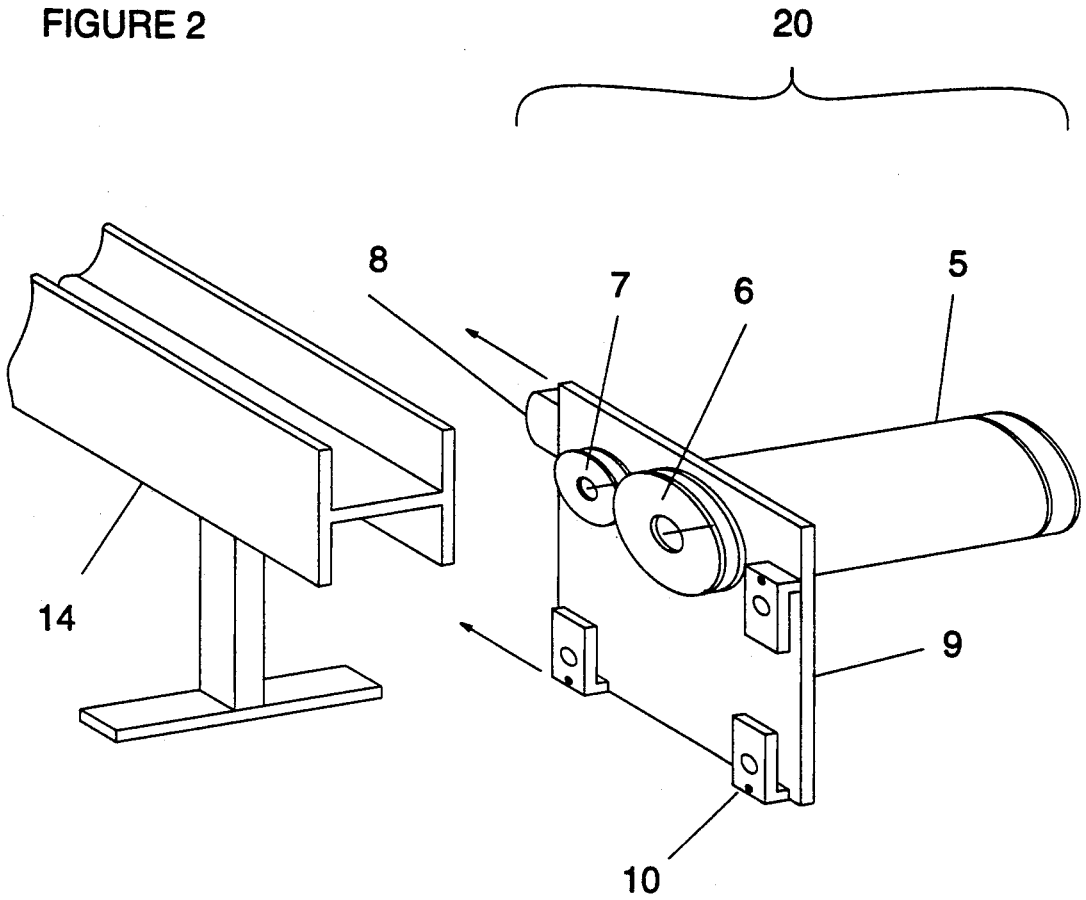
FIG. 2 shows a view of an embodiment of the motor drive unit in accordance with the present invention along with an illustration of how said unit can be mounted on a sample I-beam track.

The motor drive unit (20) (see FIG. 2) is comprised of a motor (5), a motor main pulley (6), a motor tension pulley (7), a rubber bumper (8), and three track clamps (10) which are all bolted into their associated holes on the motor backing plate (9). The motor tension pulley (7) is preferably constructed similarly to the carriage wheel (3) previously described.

Figure 4:
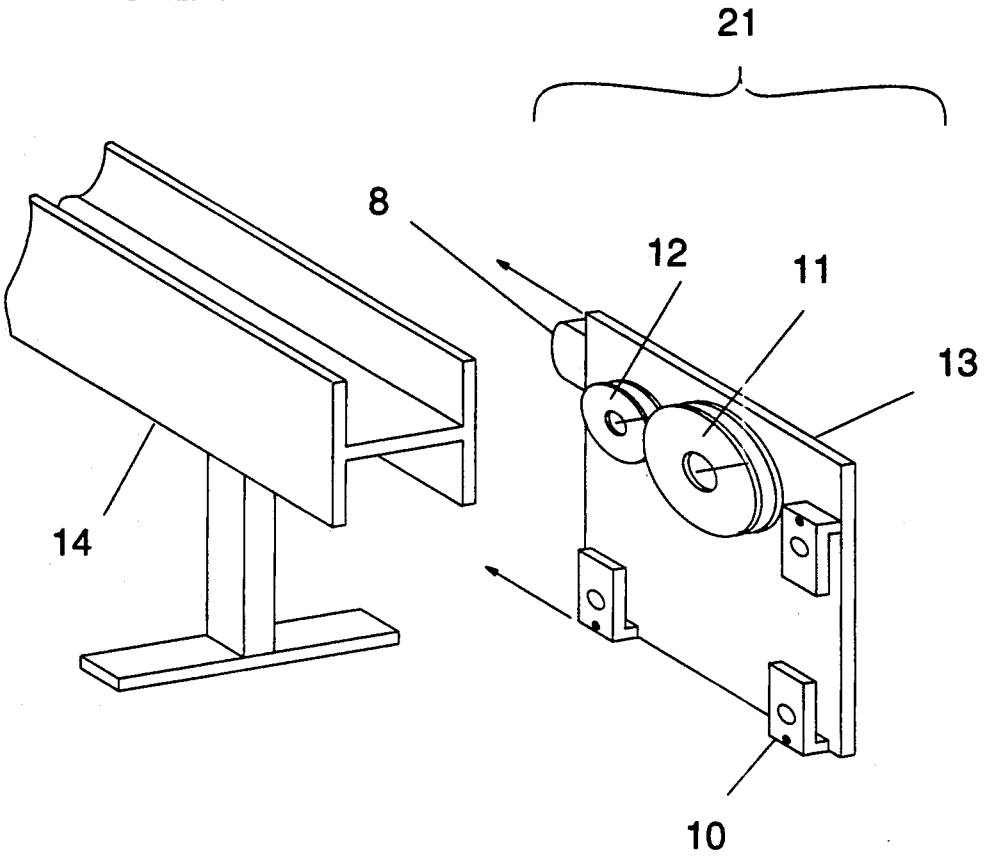
FIG. 4 shows a view of an embodiment of the idler unit in accordance with the present invention along with an illustration of how said unit can be mounted on a sample I-beam track.

The idler unit (21) (see FIG. 4) is comprised of an idler main pulley (11), an idler tension pulley (12), a rubber bumper (8), and three track clamps (10) which are all bolted into their associated holes on the idler backing plate (13). The idler main pulley (11) and idler tension pulley (12) are preferably constructed similarly to the carriage wheel (3) previously described.

When mounted to the track (14), (see FIG. 6) the motor drive unit (20), and the idler unit (21) are linked together by the drive cable (15) which is attached to the cable bracket (2) on the carriage (19) by two springs (16).

The operation of the preferred embodiment of this present invention is basically as follows:

The carriage wheels (3) are spaced appropriately on the carriage plate (1) so as to just fit onto the flange of the track (14). The grooves in the carriage wheels (3) ride on the top and bottom edges of one flange (front or rear) of the track. In this way, the carriage (19) is free to move back and forth but it can not come off the track (14). Each carriage wheel (3) can be mounted in any one of 3 holes (17), all located close together but offset slightly in the vertical axis so that the user can adapt the system to tracks of slightly different sizes by moving the carriage wheels (3) to a different set of holes.

Four target mounting studs (4) are located near the corners of the carriage plate (1). These are used for attachment of lumber strips (18) which hold a cardboard or paper target at the appropriate height. By drilling holes in the lumber strips (18), sliding them onto the target mounting studs (4), and then applying nuts, or wing nuts (not shown) to the target mounting studs (4), the lumber strips (18) are held firmly in place above the carriage (19).

The cable bracket (2) is formed such that it protrudes into the cavity formed by the shape of the I-beam track. This provides an optimum attachment point for the drive cable (15) which propels the carriage (19) back and forth on the track (14). For "right side up" operation, the drive cable (15) runs in the upper cavity of the track (14) (see FIG. 6). By turning the carriage (19) over, it can be operated "up side down" such that the drive cable (15) can run in the lower cavity of the track (14) (see FIG. 7). The symmetrical design of the carriage plate (1) allows operation in either mode.

Figure 6:
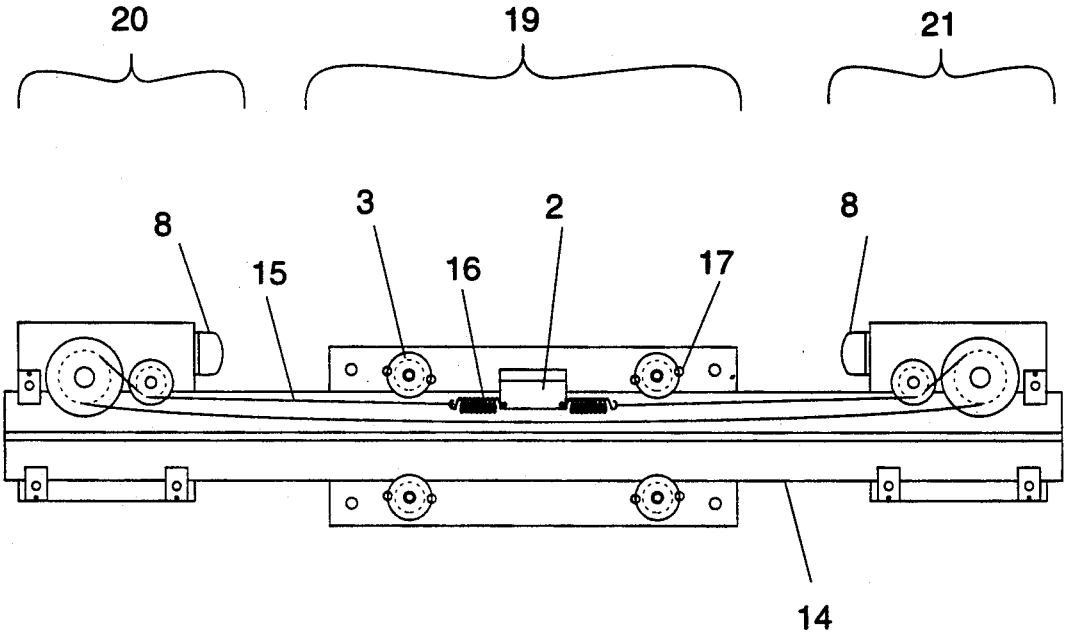
FIG. 6 shows a view of embodiments of the motor unit, carriage, and idler unit in accordance with the present invention installed on an I-beam track in the "right side up" operation mode.
Figure 7:
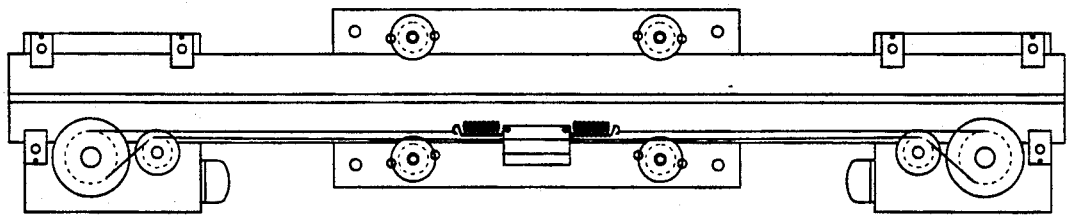
FIG. 7 shows a view of embodiments of the motor unit, carriage, and idler unit in accordance with the present invention installed on an I-beam track in the "up side down" operation mode.

After the carriage (19) has been placed onto the track (14), the motor drive unit (20) and the idler unit (21) can be attached, each at one end of the track (14) (see FIG. 6). Both units employ track clamps (10) to hold them in place on the track (14). A bolt (not shown) passes through a hole in the plates (9)(13) and then into the threaded hole in the track clamp (10). When the bolts are loose, the unit can slide freely along the length of the track (14). But when the bolts are tightened, the clamps tighten down on the flange of the track to hold the units (20)(21) in position.

The motor main pulley (6) is attached to the shaft of the motor (5) which shaft protrudes through a hole in the motor backing plate (9). The motor tension pulley (7) is mounted in a hole in the motor backing plate (9) near the motor main pulley (6). The drive cable (15) runs over the motor main pulley (6) and then under the motor tension pulley (7). This unique design causes more of the drive cable (15) to be in contact with the motor drive pulley (6) and it also keeps the drive cable (15) down inside the cavity of the track (14).

The idler unit (21) is designed essentially similar to the motor drive unit (20) with the exception that, instead of the motor (5) and the motor main pulley (6) used on the motor drive unit (20), there is the idler main pulley (11) which, like the tension pulleys (7) (12), is free spinning.

With the carriage (19), the motor drive unit (20), the idler unit (21), and the drive cable (15) in place on the track, the tension on the drive cable (15) can be easily adjusted by sliding the motor drive unit (20) or the idler unit (21) toward the end of the track (14) and then tightening the track clamps (10).

When power is applied to the motor (5), the motor main pulley (6) spins and applies a force to the drive cable (15). This causes the carriage (19) to move along the track until it reaches the end of its run. There are rubber bumpers (8) mounted on the motor drive unit (20) and the idler unit (21) (see FIG. 6) to cushion the impact as the carriage (19) reaches its extreme.

The motor (5) is preferably a commercially available, direct current (reversible) type unit which can stop and change directions instantaneously. By using a standard, commercially available, variable voltage, direct current power supply (not shown), the user can vary both the direction and the speed of the carriage (19).

Figure 3:
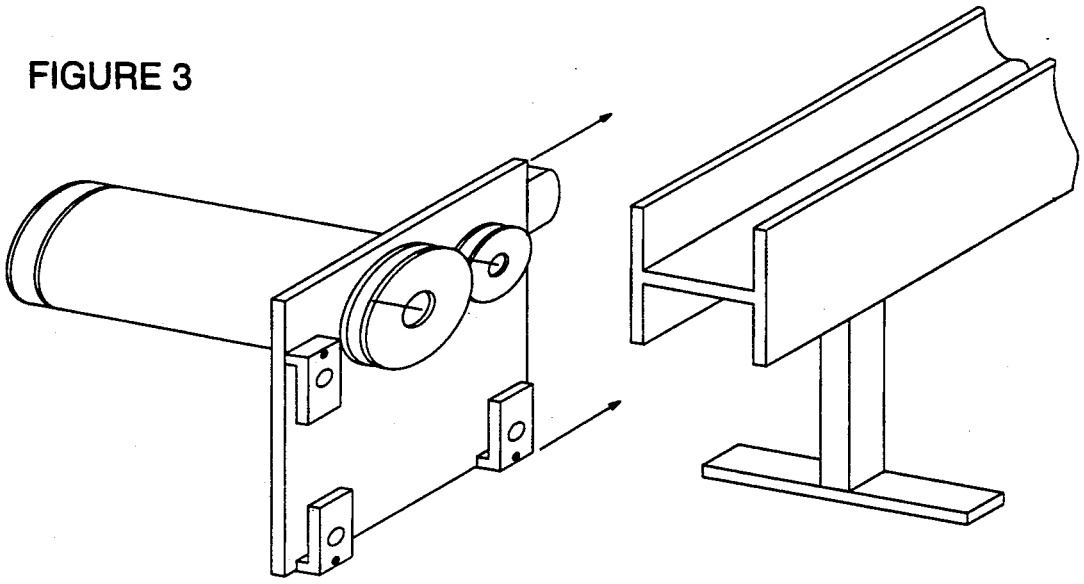
FIG. 3 shows a view of an embodiment of the motor drive unit in accordance with the present invention with the components removed and reassembled on the opposite side of the motor backing plate along with an illustration of how said unit can be mounted on a sample I-beam track.
Figure 5:
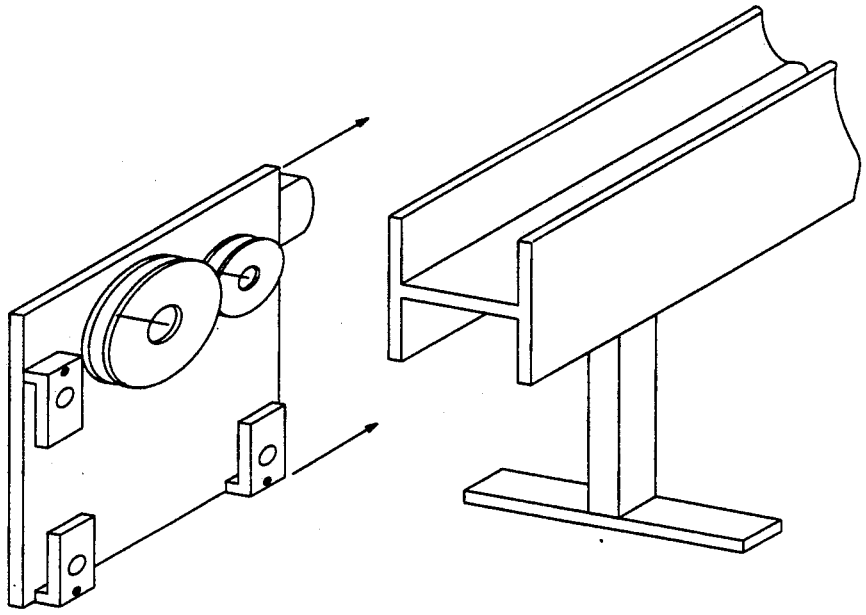
FIG. 5 shows a view of an embodiment of the idler unit in accordance with the present invention with the components removed and reassembled on the opposite side of the idler backing plate along with an illustration of how said unit can be mounted on a sample I-beam track.

As previously mentioned, the present invention only occupies a single flange on the I-beam track (14). This means that a second such system could be installed on the remaining flange for simultaneous operation. However, by moving the system around to the opposite flange, the motor drive units (20) for the two systems would be at opposite ends of the track (14). The increased difficulty and expense in running control wires to such a system can be avoided by using the "mirroring" feature of the present invention:

Since both the motor backing plate (9) and the idler backing plate (13) are simple, flat plates, the components mounted to each can be removed and reassembled on the opposite side of the plate. (See FIG. 3 for the mirrored motor drive unit (20) and FIG. 5 for the mirrored idler unit (21). By configuring one of a dual system in this mirrored fashion, both systems will have the mirror drive units (20) at the same end of the track (14).

It is understood that the present invention is not limited to the preferred embodiment presented but is susceptible to a number of modifications as are apparent to one skilled in the art. For instance, simple cover plates can be constructed to cover the motor and idler units for protection from weather or other potentially damaging elements. I do not, therefore, wish to limit the present invention to the detail shown and described herein, but intend to cover all modifications which are obvious to one skilled in the art.

The embodiments of the invention in which an exclusive property or privilege is claimed are defined as follows:

1. An improved moving target system comprising:
   (a) A support structure and system which holds a cardboard or paper target above a carriage which moves back and forth under operator control, and which starts and stops quickly because of its low mass and friction;
   (b) A motor drive unit;
   (c) An idler unit;
   (d) A drive cable which connects the motor drive unit, the idler unit, and the carriage;
   (e) A unique roller means which increases traction on the drive cable to further aid in quick starting and stopping.
   (f) A universal mechanical interface to an I-beam track structure;
   (g) A unique clamping means which allows the drive components to mount to the track at any location, thereby allowing the user to change the distance the target can run by simply sliding the drive components back and forth on the track.

2. A system according to claim 1 providing a universal mounting means which allows the motor drive unit and idler unit to function equally well at either end of the track structure.

3. A system according to claim 1 providing a universal mounting means which allows the entire assembly to be mounted to the track structure either "right side up" or "up side down."

4. A system according to claim 1 providing a universal mounting means which allows the entire assembly to operate on either of the two standard I-beam flanges, thereby allowing operation of two independent moving target systems on the same track.

* * * * *